US012644366B1

(12) United States Patent
Mulacek et al.

(10) Patent No.: US 12,644,366 B1
(45) Date of Patent: Jun. 2, 2026

(54) SYSTEM AND METHOD FOR SUPERHEATED WORKING FLUID INJECTION INTO A WELL

(71) Applicant: Empire Petroleum Corporation, The Woodlands, TX (US)

(72) Inventors: Phil E. Mulacek, The Woodlands, TX (US); William J. West, The Woodlands, TX (US); Terrance L. Strickland, The Woodlands, TX (US)

(73) Assignee: Empire Petroleum Corporation, The Woodlands, TX (US)

( * ) Notice: Subject to any disclaimer, the term of this patent is extended or adjusted under 35 U.S.C. 154(b) by 0 days.

(21) Appl. No.: 19/348,596

(22) Filed: Oct. 2, 2025

Related U.S. Application Data

(60) Provisional application No. 63/704,105, filed on Oct. 7, 2024.

(51) Int. Cl.

| | |
|---|---|
| ***E21B 43/24*** | (2006.01) |
| ***F22B 29/06*** | (2006.01) |
| *F23N 5/00* | (2006.01) |

(52) U.S. Cl.
CPC ..... *E21B 43/24* (2013.01); *F22B 29/06* (2013.01); *F23N 5/006* (2013.01); *F23N 2900/05001* (2013.01)

(58) Field of Classification Search
CPC ..... E21B 43/00
See application file for complete search history.

(56) References Cited

U.S. PATENT DOCUMENTS

| | | | | |
|---|---|---|---|---|
| 9,447,657 | B2 * | 9/2016 | Parker | C02F 5/14 |
| 2016/0169451 | A1 * | 6/2016 | Sauve | F17D 1/18 137/341 |

* cited by examiner

*Primary Examiner* — William D Hutton, Jr.
*Assistant Examiner* — Avi T Skaist
(74) *Attorney, Agent, or Firm* — Kean Miller LLP; Lauren J. Rucinski; Robert Devin Ricci

(57) ABSTRACT

A fluid heater may include an inlet operable to receive a working fluid at a first temperature, a heat exchanger coupled to the inlet and operable to heat the working fluid to a second temperature, a burner operable to supply heat to the heat exchanger, and an outlet operable to receive the heated working fluid and inject the heated working fluid into a hydrocarbon wellbore to reduce a viscosity of the hydrocarbon. The heated working fluid at the outlet may be pressurized to a pressure above atmospheric pressure, and the second temperature may be higher than a boiling point of the working fluid at atmospheric pressure.

15 Claims, 6 Drawing Sheets

SYSTEM AND METHOD FOR SUPERHEATED WORKING FLUID INJECTION INTO A WELL

CROSS-REFERENCE TO RELATED APPLICATIONS

This application claims the benefit of U.S. Provisional Application No. 63/704,105 entitled FLUID HEATER FOR HYDROCARBON VAPORIZATION, filed on Oct. 7, 2024.

STATEMENT REGARDING FEDERALLY SPONSORED RESEARCH OR DEVELOPMENT

Not Applicable

BACKGROUND OF THE INVENTION

Field of the Invention

This disclosure relates to a system for drilling oil that incorporates the injection of superheated fluids to stimulate production.

This disclosure relates in general to hydrocarbon vaporization, and more particularly to an apparatus for superheating water or other fluids prior to injection into a well.

Background Information

Hydrocarbons such as crude oil, natural gas, and condensate are produced from wells that are typically drilled several miles underground into strata or formations of rock. Pressurizing the well with water (e.g., produced water, treated water, freshwater, saltwater, etc.) or another fluid may displace the hydrocarbons and cause them to flow toward the surface. In existing solutions, water is injected at ambient temperature. It would be advantageous to heat the water to a significantly higher temperature in order to reduce the viscosity of the hydrocarbons (e.g., including vaporizing some or all of the hydrocarbons), and improve extraction.

Contact between hydrocarbons and high-temperature, high-pressure working fluid can cause partial vaporization of lighter fractions, enhancing mobility in the reservoir. This effect is favorable to recovery but requires careful control of operating temperature and residence time to avoid excessive vaporization or thermal degradation.

The disclosed method and system provides significant improvements over prior art enhanced oil recovery ("EOR") techniques by using superheated steam injection (generally, >85% wet steam), in which water is the driving fluid in the preferred case. Compared to other injection methods that employ carbon dioxide ("$CO_2$"), polymers, or other specialized fluids, water-based steam injection delivers higher energy density for superheated steam generation, directly enhancing the thermal drive in the reservoir. This results in a more efficient reduction of crude oil viscosity, improved hydrocarbon mobility, and ultimately, greater recovery efficiency from the reservoir to surface storage facilities.

$CO_2$ injection requires a continuous supply chain, including capture, compression, transport, and injection infrastructure, all of which significantly increase capital and operational expenditures. Polymer flooding depends on expensive specialty chemicals and has significant performance limitations under elevated temperatures and high salinity conditions often encountered downhole. By contrast, steam injection using produced or source water leverages an existing by-product of oil production, reducing chemical costs and avoiding the need for large-scale $CO_2$ handling or polymer preparation infrastructure. This translates into lower capital intensity and reduces operational complexity. Further, by combining superheated steam injection with the thermal properties of conditioned produced water, the inventive method and system is capable of increasing the hydrocarbon recovery factor by up to 25%, depending on reservoir characteristics. This level of improvement is not consistently attainable with known $CO_2$ or polymer injection methods.

Conventional steam injection systems are extremely sensitive to scaling and corrosion when produced water is introduced. The inventive method and system mitigate scaling and corrosion impacts through the implementation of precise water-quality envelopes (e.g., hardness, dissolved oxygen ("DO"), oil, suspended solids ("SS"), total dissolved solids ("TDS"), and pH) and advanced pre-treatment. These water-quality standards coupled with the inventive real-time monitoring systems with automated safety shutdowns, provides long-term and reliable operation.

Finally, the inventive method and system provides advantages over the prior art due to its compact design. Conventional steam generators require large water volume, segmented-dominant units. This invention offers a compact, high-capacity single-pass design, which balances portability, case of installation, and high thermal efficiency, making it suitable for deployment in both mature fields and remote environments.

SUMMARY OF THE INVENTION

The disclosed steam generator may comprise a single-pass, compact unit engineered to convert produced water into superheated steam for injection into hydrocarbon-bearing formations. Unlike conventional multi-section steam generators that rely primarily on radiation heat transfer, the disclosed unit integrates convection contact and internal radiation mechanisms within a simplified coil assembly designed as a heat exchanger. Thus, the system and method eliminate the need for segmented convection and radiation sections, or complex transition zones, while achieving heat capacities above 5 MMBTU/hr. within a reduced footprint.

In accordance with embodiments of the present disclosure, a heating element may include an inlet operable to receive a working fluid at a first temperature, a heat exchanger coupled to the inlet and operable to heat the working fluid to a second temperature, a burner operable to supply heat to the heat exchanger, and an_outlet operable to receive the heated working fluid and direct it through piping or other conduit for injection into a hydrocarbon wellbore to reduce viscosity of the hydrocarbon. The heated working fluid at the outlet may be pressurized to a pressure above atmospheric pressure, and the second temperature may be higher than a boiling point of the working fluid at atmospheric pressure.

In accordance with embodiments of the present disclosure, a method may include transmitting a working fluid into an inlet of a fluid heater at a first temperature; heating the working fluid to a second temperature in a heat exchanger that is coupled to the inlet, wherein the fluid heater includes a burner operable to supply heat to the heat exchanger; and transmitting the heated working fluid to a hydrocarbon wellbore via an_outlet of the fluid heater and injecting the heated working fluid into the hydrocarbon wellbore to reduce a viscosity of the hydrocarbon; wherein the heated working fluid at the outlet is pressurized to a pressure above atmospheric pressure, and wherein the second temperature is higher than a boiling point of the working fluid at atmospheric pressure.

It is to be understood that both the foregoing general description and the following detailed description are examples and explanatory and are not restrictive of the claims set forth in this disclosure.

BRIEF DESCRIPTION OF THE DRAWINGS

The drawings constitute a part of this specification and include exemplary embodiments of the FLUID HEATER FOR HYDROCARBON VAPORIZATION, which may be embodied in various forms. It is to be understood that in some instances, various aspects of the invention may be shown exaggerated or enlarged to facilitate an understanding of the invention. Therefore, the drawings may not be to scale.

DETAILED DESCRIPTION OF THE INVENTION

Figure 1:
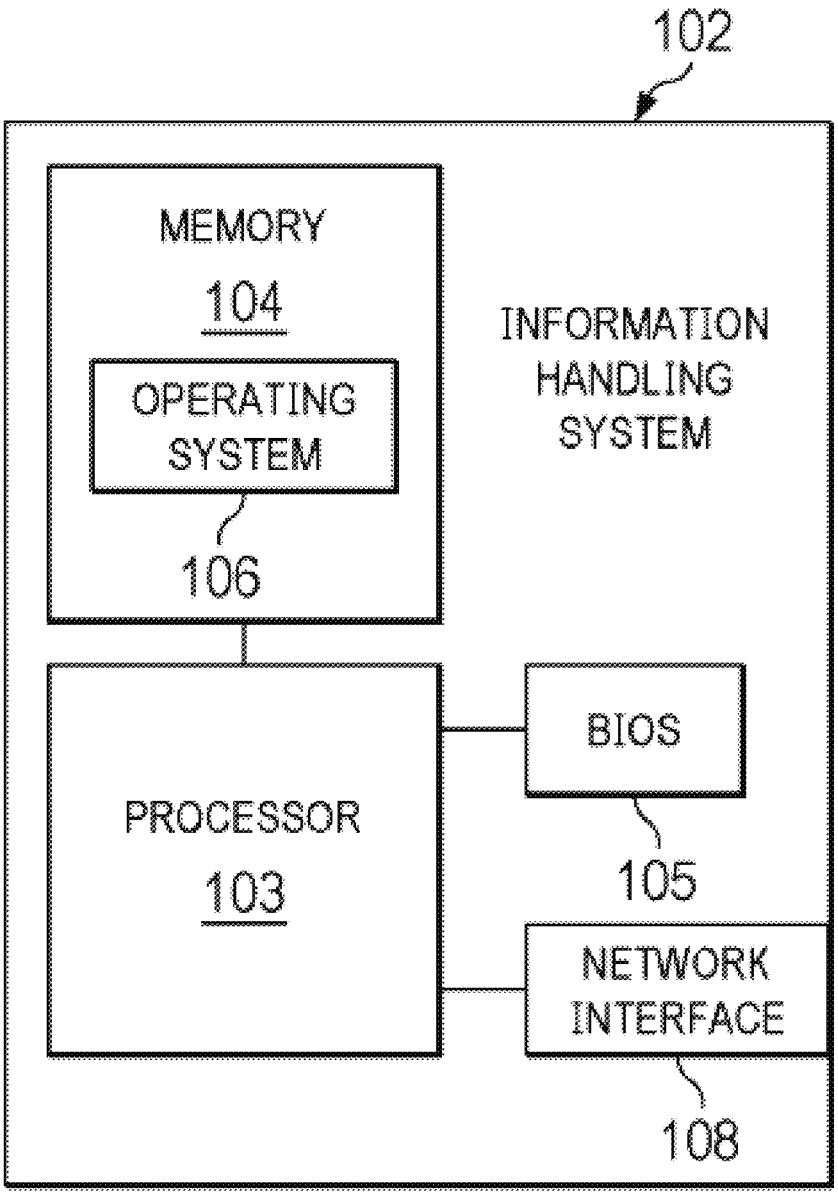
FIG. 1 illustrates a block diagram of an example control system, in accordance with embodiments of the present disclosure.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies.

This system may comprise in one or more embodiments a compact, once-through superheated steam generator for thermal enhanced oil recovery ("TEOR") and a method for using same. In one or more embodiments, the method comprises reuse of a working fluid, conditioned within desired quality limits, to generate superheated steam injected into vertical, slant, or horizontal wells. The method reduces crude viscosity, prevents paraffin and asphaltene deposition, and increases hydrocarbon recovery by up to 25% compared to conventional recovery methods.

In one or more embodiments, the system design includes a once-through flow path where feedwater is pumped from the storage tank through staged filtration and pre-treatment components, followed by heating coils within the steam generator unit (otherwise referred to herein as the heating element), and then directed to the injection well through an insulated pipeline. The flow path incorporates isolation globe, gate and check valves, relief valves for purging or discharge currents, and control valves to regulate flow rate, pressure, and recycle loops depending on volume/temperature conditions at the heater inlet/outlet.

The system and method are effective for both heavy oils and medium or light crudes and is designed for a range of volume applications, including those producing 750 bbl/day, scalable up to 1,250 bbl/day or more. However, the system and method are particularly effective in reservoirs (i) producing heavy oils or highly viscous crudes, where mobility is limited at the reservoir and surface conditions and (ii) light to medium crudes with a strong tendency to form or precipitate high concentrations of paraffins and asphaltenes, which reduce flowability.

The system and method may be applied in vertical, slant, and/or horizontal well applications. In horizontal wells applications, uniform steam distribution also can be achieved via sliding sleeves, packers, selective injection points, or inflow control devices, preventing early channeling and maximizing reservoir contact. The method and system reduces crude oil viscosity from initial values of 5-1,000+cP to below 50 cP, mitigates paraffin and asphaltene deposition in the formation and production tubing, and enhances oil mobility and production flow continuity.

The inventive system comprises two main subsystems: the injection system and the control system. The injection system comprises a fluid source, heating element, and related piping. In one or more embodiments, the heating element comprises a specially designed heat exchanger and a burner. In one or more embodiments, the injection system comprises pre-treatment equipment for the working fluid before it is in directed to the heating element. The single-chamber convection-radiation configuration ensures stable high-quality output, lowers pressure drawdown, increases sweep efficiency, and reduces energy consumption. Additional benefits include mitigation of paraffin precipitation in light crudes and reduction.

In one or more embodiments, the control system comprises integrated real-time monitoring and automated safety controls that supports reliability. In some embodiments the control system ensures operation of the injection system within a pre-determined envelope of relevant parameters, including pressure, temperature, and water composition at various locations within the injection system.

Pre-treatment may include introduction of chemical additives comprising scale inhibitors, coalescers, demulsifiers, acidification (for example, to maintain desired pH such as 7.8-8.5), dispersants, and oxygen scavengers. In these embodiments, the chemical additive may be blended into the injection water stream. Additive concentration is determined by produced water chemistry and reservoir conditions. In one or more embodiments, the working fluid is stored and conditioned through filtration and dosing units before being driven by a positive displacement triplex pump with to the heating element. Prior treated or un-treated working fluid may undergo staged filtration (for instance, 100 mesh to finer) and additional chemical conditioning.

In one or more embodiments, bench-scale analysis (CWA or ICP) may be used to quantify scaling ions ($Ca^{2+}$, $Mg^{2+}$, $HCO_3^-$), oil content, and suspended solids. The results of the bench-scale analysis may then be used to determine chemical dosing strategies for pre-treatment and the selection of heating element metallurgy.

Steam injection processes inherently lead to an increase in produced water volumes due to post-condensation effects in the reservoir, particularly in continuous steam injection operations. Accordingly, in one or more embodiments, the design of surface facilities provides for additional capacity for receiving and storing the additional working fluid such as through tanks, holding ponds, or other methods as known in the art. The pre-treatment step may be performed in such tanks, holding ponds, or other sufficient method of receiving and storing the working fluid.

After optional pre-treatment, the working fluid is introduced to the heating element by a high-pressure pump and series of piping connecting the working fluid storage to the heating element. The pump preferably delivers the high-pressure water at upwards of 3,000 psi. The heating element comprises an advanced coil design that acts as a heat exchanger and a burner. The coil design produces turbulent flow with a Reynolds Number (Rc) of 2,5000 to 10,000 and a residence time sufficient to superheat the working fluid. The coil design provides effective heating while minimizing the risk of localized hot spots and scaling when used in connection with the control system to maintain the desired operating parameter envelopes identified herein.

In one or more embodiments, the heating element may comprise a plurality of pipe members or coils. In a preferred embodiment, the heating element comprises a plurality of pipe members which may be interconnected. The pipe members may be arranged in a substantially parallel manner in relation to each other, allowing for a gap or space between the outer walls of the pipe members. In related embodiments, the pipe members may be arranged in a cuboidal or rectangular prism footprint. The pipe members may be interconnected to form a series of channels or passageways. In a preferred embodiment, the pipe members may be interconnected to form a single channel or passageway with a single inlet and a single outlet. One or more additional valves may be interspersed throughout the coil to allow access to various areas of the channel or passageway. In one or more embodiments, the pipe members or coils may have an effective internal volume of approximately 0.2 to 0.3 $m^3$. However, other embodiments have provide more or less volume depending on the application.

In one or more embodiments, the system and method produce steam with a sustained quality at or above 80%, corresponding to a predominantly superheated state with superior enthalpy and heat-transfer efficiency. Steam at this level provides deeper reservoir penetration, more uniform heating, faster viscosity reduction, and improved hydrocarbon mobilization across heavy, medium, and light crudes. Steam at 70% quality, typical of conventional multi-section boilers, contains a high liquid fraction that reduces efficiency. At 50% quality, the stream resembles a saturated steam-water mixture with limited calorific power and at 30%, the injection is effectively hot water with less recovery potential. However, these lower steam qualities may be advantageous for certain applications, including lighter crudes.

Residence time depends mainly on the internal coil volume and flow rate, as well as the thermal and hydraulic behavior of the fluid as it moves through the single-pass section(s). For single-phase flow in a straight/coil tube, residence time is:

$$t=\rho\times D/(L/\mathrm{Re}\times\mu) \text{ where } t(s),L(m),D(m),\rho(kg/m^3),\mu(Pa\times s),\mathrm{Re}(-).$$

Thus, for a constant Re band, e.g., 2,500 to 10,000, higher viscosity (μ) or longer coils (L) raise (t); larger (D) and higher (φ also increase (1).

These calculations are based on a pre-boil/liquid-equivalent approximation. Once the working fluid reaches boiling temperatures, residence time decreases based on a rise in void fraction and local velocities. Accordingly, the residence time is calculated as a global (liquid-equivalent) residence time.

In one or more embodiments, the coils are helical and are between 150 and 200 meters in length with an effective internal diameter of between 33-38 mm. At these dimensions, with a flow rate of 1,500 bwpd, a global (liquid-equivalent) residence time is between 46.5 and 82.2 seconds. In one or more embodiments, the residence time is between 60 and 65 seconds. In this or other embodiments, the superheated steam has an operating envelope of Re between 2,500 and 10,000, a steam quality of ≥80%, and outlet temperature ≥260° C., thereby limiting hot spots and scaling under closed-loop control.

In one or more embodiments, the injection pump is rated for about 2,500-3,000 bwpd. In other embodiments, the heating element is configured to operate at an average throughput of about 1,000-1,500 bwpd. In or one or more embodiments, the pump accommodates varying flow rates from 2,500 to 3,000 barrels of working fluid per day. The pump is in electronic communication with the control system such as through a control panel, that manages flow and heating optimization.

In one or more embodiments, metallurgy for the injection system is defined as ASME SA106 Grade B Sch. 80 or ASTM A213 T12 alloy Sch. 80. In one or more embodiments where higher resistance to scaling, corrosion, or extended operating life is required, chromium carbon steel or Inconel alloys may be employed as an alternative material. Although a specific embodiment of the heat exchanger is described herein, other materials of construction may be used that are compatible with water chemistry, ensuring resistance to scaling, corrosion, and high-temperature operation.

In one or more embodiments, the system may be continuously monitored and managed through the control system to mitigate carbonate scaling. In one or more embodiments, solvent-based chemical treatments or acid treatments are applied when the calcium concentration reaches a pre-set value. For instance, if the calcium concentration is above 1,000 ppm, solvent-based chemical treatments may be applied. In one or more embodiments, the calcium concentration is less than 0.1 mg/L.

In one or more embodiments, the system and method are adapted to reuse or recycle produced or source water derived from oil production as the working fluid for steam generation. In these embodiments where recycled produced water is the working fluid, the water is conditioned to meet the operational limits or envelope to ensure consistent steam quality and equipment longevity in Table 1. The envelope is developed to mitigate or prevent film boiling and hot spots, accelerated scaling, insulation damage, unstable flame, and unnecessary fuel burn. Additionally, the chemistry of the working fluid is controlled to stay within certain pH and dissolved oxygen, silica, and hardness are all monitored and controlled to mitigate deposition during cooling.

TABLE 1

| | |
|---|---|
| Hardness | ≤0.1 mg/L |
| Dissolved Oxygen | ≤0.05 mg/L |
| Iron | ≤0.05 mg/L |
| Silica | ≤50 mg/L |
| Oil and Grease | ≤2 mg/L |
| pH at steam unit inlet | 7.8-8.5 |
| Suspended Solids | ≤2 mg/L |
| TDS | ≤5,000 mg/L |
| Total Alkalinity | ≤2,000 mg/L |

TABLE 1-continued

| Flow Capacity | 500-3,000 bwpd |
|---|---|

In one or more embodiments, working fluid hardness is less than or equal to 0.1 mg/L. In other embodiments, the system remains operable with about 0.1-0.5 mg/L when anti-scalants and polishing softeners are applied; in further embodiments, up to about 1.0 mg/L is tolerated with shortened maintenance intervals and enhanced monitoring. Hardness values >approximately 1 mg/L materially raise carbonate and silica co-scaling risk and are generally avoided for long runtime.

In one or more embodiments, dissolved oxygen ("DO") in the working fluid is less than or equal to 0.05 mg/L. Operability extends to about 0.05-0.10 mg/L with oxygen scavenger dosing (e.g., sulfite) and deaeration; up to about 0.20 mg/L may be accommodated short-term with corrosion inhibitors and tighter pH control, at the expense of coil life. Above approximately 0.20 mg/L significantly increases oxidative corrosion and is disfavored.

In one or more embodiments, total iron in the working fluid is less than or equal to 0.05 mg/L. Operation remains acceptable at approximately 0.05-0.10 mg/L with filtration and chelation; up to about 0.30 mg/L can be managed short-term, recognizing higher fouling and an indication of upstream corrosion. Iron levels greater than approximately 0.30 mg/L are typically corrected prior to injection.

In one or more embodiments, silica concentration in the working fluid is less than or equal to 50 mg/L. In other embodiments, approximately 50-100 mg/L is operable with pH management and anti-scalants; up to approximately 150 mg/L may be tolerated with increased cleaning frequency and/or metallurgy upgrades, noting elevated deposition risk at superheat zones. Silica concentrations above approximately 150 mg/L are undesirable.

In certain embodiments, oil and grease concentrations in the working fluid are less than or equal to 2 mg/L. Operability extends to approximately 2-5 mg/L with coalescers and cartridge filtration; up to about 10 mg/L may be accommodated briefly with higher antifoam dosing and more frequent filter changes, recognizing coking/foaming risk. Concentrations above approximately 10 mg/L is undesirable for steam quality and coil cleanliness.

In one or more embodiments, to mitigate or prevent corrosion in the coils (e.g., when the coils comprise carbon-steel), a slightly alkaline window of pH approximately 7.8-8.5 is preferred. Broader operability is extended to pH of 5.0-9.0 with appropriate inhibitors and metallurgy selection. However, sustained acidic operation increases corrosion risk and excessively high pH (>approximately 9.5) can promote caustic attack and foaming.

In one or more embodiments, suspended solids concentration ("SS") in the working fluid is less than or equal to 2 mg/L. Operability extends to about 2-5 mg/L with tighter filtration (e.g., ≤5 μm) and purge control; concentrations up to about 10 mg/L may be tolerated short-term with higher filter change-out rates. However, greater than approximately 10 mg/L elevates erosion and/or plugging risk and is, therefore, undesirable.

In one or more embodiments, total dissolved solids ("TDS") in the working fludi are less than or equal to 5,000 mg/L. In other embodiments, approximately 5,000-7,500 mg/L is operable with upgraded chemical conditioning and alloy selection; concentrations of up to approximately 10,000 mg/L can be managed with enhanced treatment and shortened maintenance intervals. However, concentrations above approximately 10,000 mg/L materially increase scaling and/or corrosion risk and are, therefore, undesirable.

In one or more embodiments, total alkalinity of the working fluid is less than or equal to 2,000 mg/L. Operability extends to about 2,000-2,500 mg/L with acid neutralization and controlled degassing; concentrations of up to approximately 3,000 mg/L may be tolerated with closer monitoring of pH, silica, and hardness. However, concentrations above approximately 3,000 mg/L complicates scale control and, therefore, is undesirable.

In one or more embodiments, the pump is rated for 2,500-3,000 bwpd. The heating element can be operated effectively at approximately 1,000-1,500 bwpd average throughput (preferred for coil residence time and thermal control), with short-term turndown below approximately 1,000 bwpd or ramp-up toward approximately 3,000 bwpd as permitted by the control system and heat-input limits. In one or more embodiments, the flow is 500 barrels to 3,000 barrels, depending on the application. Thus, the specifications of the coil may be configured to accommodate a wide range of field applications. The operational flexibility represents an advantage of the invention, as it allows the unit to be tailored to diverse reservoir conditions and production strategies, thereby maximizing efficiency and adaptability across multiple enhanced oil recovery applications.

After treatment and heating, the superheated steam is directed into a reservoir through insulated piping. Isolation, control, relief, and recycled valves are used to regulate pressure, temperature, and flow rates dynamically. Flow is monitored and controlled by the control system and preferably, automated monitoring system and instrumentation. In one or more embodiments wherein the working fluid is water, the steam outlet temperature to the reservoir is maintained above 260° C. (500° F.). The temperature is maintained through adjustments made by the control system, in some embodiments in real time, to fuel input to the burner and flow rate of the water through the inlet of the injection system.

FIG. 1 illustrates a block diagram of an example control system (or sometimes referred to herein as the information handling system) 102, which may be used for such control.

For the purposes of this disclosure, the term "control system" may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, a control system may be a personal computer, a personal digital assistant ("PDA"), a consumer electronic device, a network storage device, or any other suitable device and may vary in size, shape, performance, functionality, and price. The control system may include memory, one or more processing resources such as a central processing unit ("CPU") or hardware or software control logic. Additional components of the control system may include one or more storage devices, one or more communications ports for communicating with external devices as well as various input/output ("I/O") devices, such as a keyboard, a mouse, and a video display. The control system may also include one or more buses operable to transmit communication between the various hardware components.

As noted, FIG. 1 illustrates a block diagram of an example control system 102. Control system 102 may comprise a server computer, a personal computer (e.g., a desktop computer, a laptop computer, a mobile computer, and/or a notebook computer), or any other type of computer. In yet other embodiments, control system 102 may comprise an embedded computing system implemented with a microcontroller and a small integrated storage resource. As shown in FIG. 1, control system 102 may comprise a processor 103, a memory Inconel communicatively coupled to processor 103, a BIOS Inconel communicatively coupled to processor 103, and a network interface Inconel communicatively coupled to processor 103.

Processor 103 may include any system, device, or apparatus configured to interpret and/or execute program instructions and/or process data, and may include, without limitation, a microprocessor, microcontroller, digital signal processor ("DSP"), application specific integrated circuit ("ASIC"), programmable logic device ("PLD"), or any other digital or analog circuitry configured to interpret and/or execute program instructions and/or process data. In some embodiments, processor 103 may interpret and/or execute program instructions and/or process data stored in memory 104 and/or another component of control system 102.

Memory 104 may be communicatively coupled to processor 103 and may include any system, device, or apparatus configured to retain program instructions and/or data for a period of time (e.g., computer-readable media). Memory 104 may include RAM, EEPROM, a PCMCIA card, flash memory, magnetic storage, opto-magnetic storage, or any suitable selection and/or array of volatile or non-volatile memory.

As shown in FIG. 1, memory 104 may have stored thereon an operating system. Operating system 106 may comprise any program of executable instructions (or aggregation of programs of executable instructions) configured to manage and/or control the allocation and usage of hardware resources such as memory, processor time, disk space, and input and output devices, and provide an interface between such hardware resources and application programs hosted by operating system 106. In addition, operating system 106 may include all or a portion of a network stack for network communication via a network interface (e.g., network interface 108 for communication over a data network). Although operating system 106 is shown in FIG. 1 as stored in memory 104, in some embodiments operating system 106 may be stored in storage media accessible to processor 103, and active portions of operating system 106 may be transferred from such storage media to memory 104 for execution by processor 103.

Network interface 108 may comprise one or more suitable systems, apparatuses, or devices operable to serve as an interface between control system 102 and one or more other control systems via an in-band network. Network interface 108 may enable control system 102 to communicate using any suitable transmission protocol and/or standard. In these and other embodiments, network interface 108 may comprise a network interface card, or "NIC."

Control system 102 may be integrated with or otherwise in electronic communication with the injection system and may be used to monitor various performance characteristics or operating parameters of the injection system including those identified in TABLE 1 and performance characteristics of the working fluid to be introduced to the injection system. The characteristic or parameter data may be gathered from sensor data integrated with the injection system. In one or more embodiments, the control system 102 may also receive input from a user regarding desired operational characteristics (e.g., a desired outlet temperature, a desired flow rate, a desired pressure).

Control system 102 may implement automation for the injection system. The automation may comprise open-loop control, closed-loop control such as a PID controller, or any other desired control scheme to provide feedback in real-time and, in some embodiments, adjust the operational parameters or characteristics in real time. For example, control system 102 may activate various relays or other switches to turn components on and off, and it may also adjust the positions of various electrically actuated valves within the injection system or coupled to the injection system in order to change the flow rate of the working fluid, the injection pressure of the working fluid, the heat output of the burner (through fuel flow or otherwise), and/or other characteristics in accordance with the control system.

The sensors, switches, valves, meters, and other information gathering apparatus that are connected to control system 102 may be network-based, for instance, connected via a wired or wireless network. In other embodiments, they may be directly wired to input/output hardware, for example, general-purpose I/O or GPIO pins, of control system 102.

In one or more embodiments, the control system 102 comprises a real-time monitoring and control systems integrated into a supervisory control and data acquisition ("SCADA") system that integrates data acquisition hardware, communication networks, and centralized operator interfaces. The SCADA system is configured to monitor, collect, and process real-time data generated by remote field devices related to the injection system, and to provide a centralized human-machine interface ("HMI") for operator oversight and control. In one or more embodiments, automated controls execute alerts and safety shutdowns if operational or water-quality limits are exceeded. This ensures that injection pressure, temperature, and viscosity remain within the operational envelope.

In one or more embodiments, the one or more field devices configured to generate operational data on the injection system may comprise one or more sensors, actuators, transducers, flow meters, pressure gauges, temperature probes, and other process-monitoring or process-controlling instruments distributed on or otherwise integrated with the injection system. In one or more embodiments, the sensors generate date on the following parameters: working fluid parameters such as temperature, pressure, oil content, pH, total dissolved solids; heating coil and other heat exchanger parameters such as temperature and pressure at the inlet and outlet, wall temperature, flow, viscosity; and burner parameters such as fuel flow, fuel pressure, flame detection, $O_2$/CO in flue gas.

In one or more embodiments, field devices may include one or more of the following: smart transmitters (4-20 mA/HART), thermocouples/RTDs, Coriolis or magnetic flowmeters, inline viscometer, pressure transmitters, pH/ORP, DO, turbidity/SS meters, oil-in-water analyzer. In one or more embodiments, the field devices comprise one or more of the following: Tube-skin temperature sensors, for example thermocouples (e.g., type K or N) and/or IR pyrometers to limit tube-metal temperature; flue/stack monitoring, for example, flue-gas temperature, stack $O_2$/CO/NOx analyzers, draft transmitters, combustion-air flow; fuel characterization analyzers, for example, on-line gas chromatograph/BTU analyzer for C1-C5 composition; fuel dew-point monitor; water chemistry analyzers, for example, conductivity/TDS, silica, sodium (leak-through), chloride (ISE), alkalinity (auto-titrator), hardness (softener effluent), TOC/COD (organic loading); corrosion and thickness analyzers, for example, LPR/ER corrosion probes, coupon racks, and UT ports for periodic thickness surveys; particulate and fouling indicators, for example, inline particle counter, DP transmitters across filters/coil, density meters (Coriolis/gamma); mechanical condition analyzers, for example vibration/accelerometers on pumps and burners/blowers; acoustic emission sensors for leak or crack onset; level or chemical dosing verification, for example tank level transmitters, load cells on chemical totes, dosing pump stroke confirmation; and steam quality analyzer, for examples, throttling calorimeter and/or inferred ("soft-sensor") steam-quality estimator.

In one or more embodiments, the field devices provide information on one or more of the following parameters: computed or derived "soft-sensor" metrics such as: thermal state, including real-time steam quality, enthalpy, superheat margin (° F. above saturation), heat duty (MMBTU/hr), overall UA and fouling factor trending; hydraulics, including residence time, Reynolds/Prandtl numbers, coil DP margin; scaling indices, including LSI/RSI/Stiff & Davis, silica saturation index; predicted precipitation rate; corrosion KPIs, including corrosion rate (mpy), iron release rate, oxygen scavenger residual control; operations economics, including SOR (steam-to-oil ratio), incremental bbl/day, burner excess air, fuel specific consumption (MMBTU/bbl).

In these and other embodiments, at least one data acquisition unit is communicatively coupled to the field devices. The data acquisition unit may include a remote terminal unit ("RTU") or a programmable logic controller ("PLC"). The data acquisition unit is configured to receive analog and/or digital signals from the field devices, to convert such signals into a format suitable for transmission, and to execute predefined control logic for managing associated process equipment. These actions may be performed through the operating system 106, processor 103, and network interface 108.

A communication network is operatively connected to the data acquisition unit(s). The communication network may include wired or wireless protocols, such as Ethernet, fiber optic links, cellular networks, satellite links, radio frequency (RF) communication, or combinations thereof. The communication network, such as through network interface 108, is configured to provide continuous and secure data transmission between the field devices and a centralized control station or processor 103 and operating system 106.

In one or more embodiments, the data collected by the field devices is integrated with the control system through the operating system 106, processor 103, and network interface 108 by combination of the Open Platform Communications Unified Architecture (OPC UA) and Modbus TCP industrial communication protocols.

In some embodiments, a centralized control interface comprises at least one HMI and may be performed on the operating system 106 and memory 104. The HMI is configured to display real-time operational data, alarms, and trend information to an operator. The HMI further provides interactive controls allowing the operator to input commands, adjust set points, or override automated functions as necessary. In one or more embodiments, the centralized control interface may also include a data historian configured to store long-term operational records for subsequent analysis and regulatory or internal reporting.

In one or more embodiments, the control system can initiate combustion controls, model-predictive control, feed-forward compensation, chemical residual controls, purge/flush/CIP sequences, multi-well flow split, and a variety of safety interlocks and protections. For example, the control system may control combustion and the heating element parameters through interconnectedness with analyzers and controls that manage oxygen-trim, furnace draft control, air to fuel ratio with or without split-range and cascade loops, burner management system permissives, and trips. The control system may implement a model-predictive control to coordinate control of the burner, working fluid flow, and chemical dosing within set coil tube-skin temperatures, coil differential pressure, and emission limits. In other examples or embodiments, the working fluid parameters are controlled through a feedforward compensation algorithm implement on the control system that comprises automatic setpoint bias for changes in the inlet TDS and/or harness, ambient temperature, and/or fuel Btu variability. Similarly, chemical dosing or pretreatment of the working fluid may be controlled through a closed-loop pH/oxidation-reduction potential automated or manual adjustments, oxygen scavenger dosing, anti-scalant dosing, and phosphate residual monitoring and control. Purging or flushing sequences may be automated by the control system to perform hot-fluish, blowdown, or clean-in-place routines with our without interlocks on the system. To protect the integrity of the metallurgy of the heating element, the control system may implement ramp-rate limits the controlled heat-up and cool-down sequences.

In one or more embodiments, the system and method may comprise supplying superheated steam to more than one injection wells. In those incidents, it would be advantageous for the control system to perform automated flow-balancing to maintain uniform steam distribution across the two or more injection lines, with or without backpressure control on injection headers.

The control system may also comprise safety interlocks that automate trips of the system based on high-high tube-skin temperature, high coil DP, low-low feed flow, flame failure, fuel-gas leak detection, low combustion air, and/or high stack temperature. The safety interlocks may also be triggered to automate a shutdown sequence if certain set triggers are met. In these embodiments, the control system implements an emergency shutdown ("ESD") protocol, safe purge, and auto-relight logic with proof-of-closure on fuel valves. In one or more embodiments, one or more of these steps may be manual or automatic. In one or more embodiments, the safety interlocks may also comprise pressure safety trigger actions such that when a relief valve reaches a set pressure, ESD valves are remotely actuated and a double block-and-bleed is implemented at the inlet of the heating element or heat exchanger.

In one or more embodiments, the SCADA system monitors the field devices, acquires and transmits data via the communication network, and presents the data to an operator through the centralized HMI. Based on the acquired data, the SCADA system may automatically adjust control parameters through the RTUs or PLCs, or present actionable information to human operators for decision-making as described in the embodiments above. In one embodiment, the PLC may comprise an SIL-rated burner management system ("BMS"), PID loops for flow, outlet temperature, coil pressure deferential, and fuel to air ratio, and modeling-based supervisory control for viscosity. In other embodiments, the PLC comprises one or more of the systems and control algorithms described above.

In one or more embodiments, the control system implements maintenance and/or diagnostic processes. These may include condition-based maintenance such as ML-based fouling and/or scaling rate prediction, filter/softener breakthrough diagnostics, and remaining-life estimates for coils. The control system may also implement testing functions such as automatic valve stroking, sensor drift detection, calibration reminders, runtime counters and maintenance windows.

In one or more embodiments, the control system restricts access through user roles as defined through cyber white-listing or any other means as known in the art to grant access only to explicitly approved applications, users, IP addresses, or devices. In one or more embodiments, other default-deny security protocols and/or cyber security measures are implemented by the control system.

Environmental compliance related to air emissions management and discharge water quality may also be assisted through the control system. In one or more embodiments where a continuous emissions monitoring system ("CEMS") is required or otherwise installed, the control system may integrate data from the CEMS with other data gathered from fuel analyzer sensors to determine the proper fuel to emissions mass balance. In cases where blowdown and/or condensate is discharged or other water discharging occurs, the control system may integrate data from produced water quality sensors and other analyzers to pre-empt discharging contaminants above regulated limits. In one or more embodiments, the volatile organic compound ("VOC") emissions from working fluid may be monitored and managed through the control system for emissions limitation and reporting compliance.

One embodiment of the PLC logic is explained next. The temperature and viscosity controls comprise a primary PID on the temperature at the outlet (T_out) with burner fuel to air ratio (η_out) control. If T_out or η_out are out of the specified range, the control will actuate increasing the heat input within metallurgy limits of the heating element (burner), open a recycle loop to increase residence time in the heat exchanger, or reduce flow at the inlet.

Scaling and corrosion are mitigated by maintaining one or more of the following parameter set points as described in TABLE 1: pH 7.8-8.5, dissolved oxygen ≤0.05 mg/L, SS ≤2 mg/L, Oil ≤2 mg/L through a PID on dosing of additives (e.g, scale inhibitor, dispersant, oxygen scavenger) based on the skid analyzers and calculated Langelier Saturation Index/Ryzner Index ("RSI"). Similarly, conformance with water-quality parameter envelopes is checked against the limits in TABLE 1 and if within range, routine monitoring is initiated or continued. A detailed re-analysis (CWA/ICP) is triggered if the values deviate abruptly or new constitutes are detected.

Filtration health is managed through setpoints for pressure change with automated alarms for operator action at a high set point (ΔP_high) and automated trips at critical set point (ΔP_HH). Flow through the injection system at the inlet is managed with pressure and flow envelopes with localized limits, e.g., 2,500-3,000 barrels per day.

Burner management is achieved through sequenced light-off and flame supervision—i.e., sequenced ignition and flame supervision control configured to automate an ordered series of operations for initiating combustion, to monitor for establishment of a stable flame condition within a prescribed interval, and to provide continuous flame supervision with automatic fuel cutoff in response to a loss-of-flame condition or failure to ignite. Sequenced ignition and flame supervision control may be used in tandem with fuel trip on flame-out, low flow, automated protective action on critical temperatures at the wall (high-high T_wall), alarm on high fuel pressure to air ratio, and high P_fuel/air fault automation. In one or more embodiments, burner management further includes a set of permissive conditions that must be concurrently satisfied prior to initiation of the firing sequence. This may include interlocking signals from analyzers for confirmed flows (fuel/air/working fluid feed), min. T_coil, all T_wall <limit, differential pressures at filters <limit, and gas detection=safe, to initiate an emergency shutdown reset function.

Figure 2:
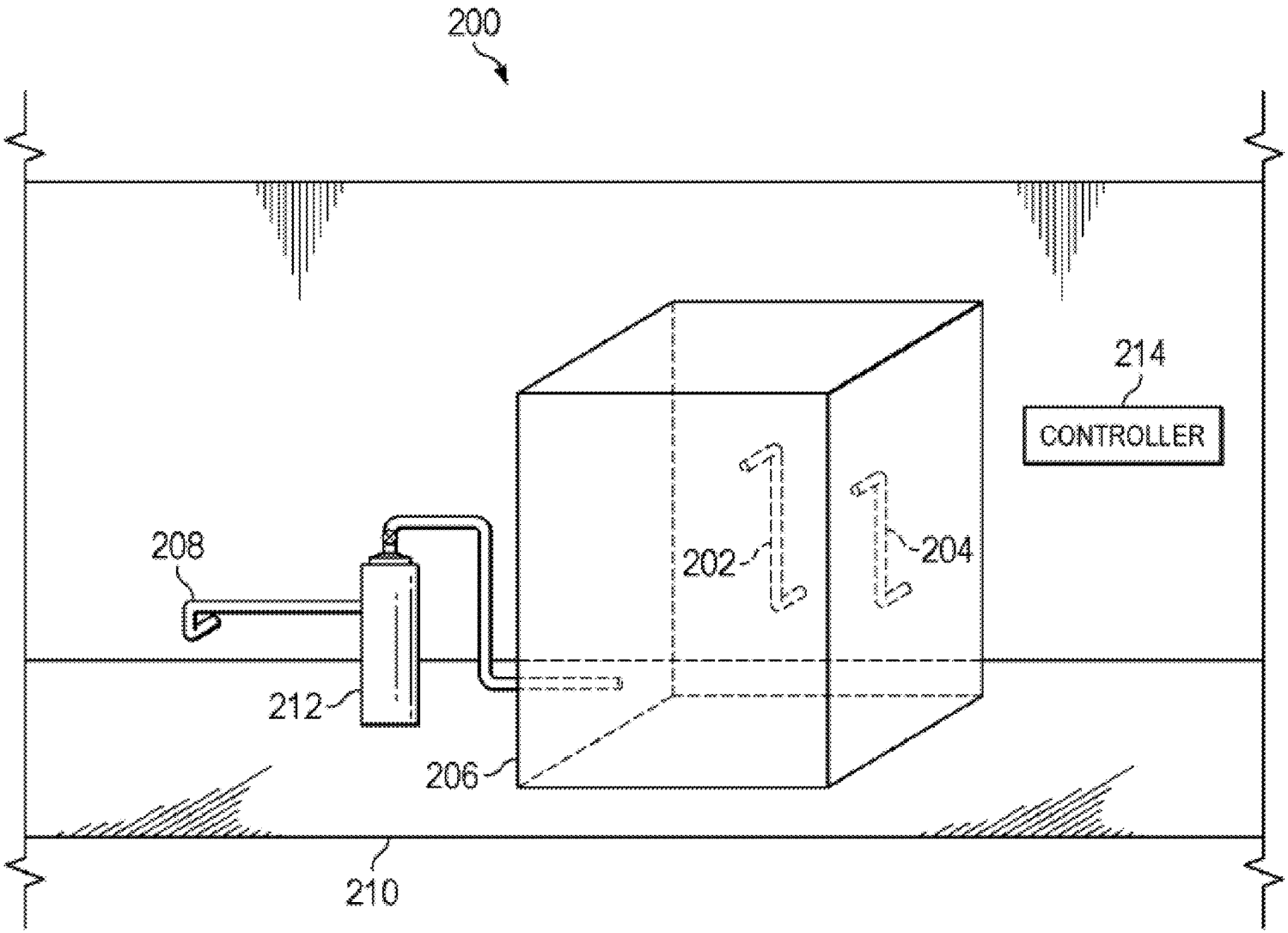
FIG. 2 illustrates a perspective view of an example fluid heater, in accordance with embodiments of the present disclosure.

Referring now to FIG. 2, a perspective view of an example heating element 200 is shown, in accordance with embodiments of the present disclosure. As shown in FIG. 2, heating element 200 includes an inlet 202 for receiving a working fluid such as water.

An internal enclosure 206 of heating element 200 may include a burner and heat exchanger coils (not shown) to heat the working fluid to a desired temperature. The burner may be set up to use field gas from the well, which would otherwise be flared and go to waste. In other embodiments, the burner may use diesel, propane, natural gas, or any other suitable fuel. In the example shown, field gas is supplied via gas inlet 208. The field gas then passes through one or more gas scrubbers 212 to remove unwanted chemical components before it is burned.

In some embodiments, the burner may be a forced-air burner including a blower. The burner may include a gas regulator to regulate the supplied field gas, which may initially arrive at a higher pressure than the design of the burner can accommodate. In one embodiment, a forced-draft natural gas burner with adjustable turndown ratio supplies heat, with a minimum thermal capacity of 5 MMBTU/hr. In one or more embodiments, the maximum wall temperature is controlled at or below 650° C., ensuring metallurgical integrity. The burner may also include a flame sensor (e.g., an ultraviolet flame scanner) for safety, in order to shut down the burner if the flame fails. The flame sensor may be in communication with the control system. The burner may also be shut down automatically through the control system or through manual operation after an alarm if the water flow rate falls below a threshold value to prevent overheating.

The heat exchanger may comprise an inlet manifold 409, an outlet manifold 410, and one or more flow passages extending therebetween. In a preferred embodiment, the inlet manifold and outlet manifold are in fluid communication with each other. The flow passages may be formed by tubes, channels, or plates arranged to provide thermal communication between the working fluids and heater. For example, the embodiment depicted in FIG. 4 uses a plurality of coils as flow passageways. The design of the heat exchanger (e.g., length of the coils, cross-sectional area of the coils) in association with controllable fluid flow characteristics (e.g., velocity and pressure) allows for a desired residence time for the working fluid within the heat exchanger.

In one or more embodiments, the working fluid with optionally pretreatment, enters the heating element through the inlet 302 that is in fluid communication with the heat exchanger inlet manifold 409. In one or more embodiments, the inlet 302 comprises nozzle that securely interfaces with the inlet manifold 409. The nozzle may be connected to a high-pressure line or other conveyance means to transport the working fluid from holding to the heating element. In one or more embodiments, a high-pressure nozzle mates with a reinforced nozzle port in the manifold 302, using a tapered or conical seating surface and high-integrity scaling arrangement configured to resist leakage of working fluid under the desired pressure loads. The inlet manifold 302 may further comprise internal baffles, diffusers, or flow directors to ensure even distribution of the feed fluid across the coils, as known in the art.

In some embodiments, an extended residence time may promote improved thermal equilibration between the fluids, thereby enhancing heat transfer efficiency. In other embodiments, reducing residence time may be advantageous to minimize fouling and reduce thermal degradation of the working fluid. The heat exchanger may further incorporate flow distributors, baffles, or channel geometries configured to adjust local fluid velocity profiles, thereby influencing the residence time distribution across the heat transfer surfaces. Computational fluid dynamics or empirical testing may be used to optimize channel geometry to achieve a target residence time for a given application. In one or more embodiments, the residence time may be between 46-83 seconds (preferably about 60-65 seconds), sufficient to produce superheated steam within the operating ranges.

After the working fluid has been heated within the heat exchanger coils, it may flow out of the heat exchanger through the outlet manifold 410 and through outlet 204. Outlet manifold 410 is configured to collect the superheated working fluid, such as steam and/or hot water, and convey it through outlet 204 to field equipment for injection into the well. Outlet 204 may be coupled to pipes which convey the heated, pressurized working fluid down the wellbore to perform injection to the reservoir. In some embodiments, the outlet manifold 410 and/or outlet 204 incorporate monitoring ports, pressure relief devices, or sampling lines that may be integrated with the control system.

Inlet 202, inlet manifold 409, the heat exchanger coils 408, outlet 204, outlet manifold 410 and the other components of heating element 200 are designed for high-pressure fluids as described above and/or as known in the art (e.g., they may be rated for up to 3,000-5,000 PSI or even higher in some embodiments). By keeping the working fluid at an elevated pressure throughout the process of heating it, it is possible to attain significantly increased temperatures without the working fluid flashing to steam. For example, some embodiments may be used to heat water from ambient temperature (e.g., 50° F.) to temperatures in excess of 600° F., which would be impossible if it were at or near atmospheric pressure. In other embodiments, the working fluid may be allowed to vaporize, and the vaporized fluid may then be injected. Steam outlet temperature may be above 260° C. (500° F.) and adjustable by fuel input and flowrate through the control system or manually. The outlet stream may contain >80% vapor fraction, depending on crude viscosity requirements.

In one or more embodiments, steam quality at the outlet may be about 75-90%, with about 20-40° F. of superheat above saturation at the injection pressure, selected to achieve, at the sandface, a crude-oil viscosity less than or equal to 10 cP for wax-prone light-medium crudes or less than approximately 50 cP for heavy oils. The dominant heat transfer in the reservoir is the latent heat of condensation. If steam/working fluid is too wet (<70% quality), unnecessary liquid water into the formation is hauled, resulting in higher steam to oil ratio and/or water banking and waste energy heating liquid that does not condense efficiently at the sandface. If the working fluid/steam is too dry at the outlet (for example, >90-95%), less latent heat per unit mass that is quickly bled off in the near-wellbore, reducing condensation. At steam rates greater than or equal to 80%, the system tolerates real-world variation in fuel BTU, water chemistry, and line heat loss while still delivering a strong condensation front. Accordingly, although steam-injection processes are conventionally applied to heavier crude oils, where viscosities can be reduced to values at or below 50 cP upon steam stimulation, this system and method are also applicable to light and medium crude oils. Such crudes, despite maintaining relatively low viscosities (as low as ~2 cP at 90-100° F. under pipeline conditions), exhibit a pronounced tendency to precipitate paraffinic components. This technical challenge is particularly relevant in North Dakota crude oils, which are generally paraffinic in nature (19-55° API) and characterized by a Wax Appearance Temperature ("WAT") typically ranging between ~90° F. and 160° F., depending on crude composition and reservoir pressure. Representative light Upper Charles-type crudes (~30-32° API) demonstrate low viscosity under surface conditions, but still undergo wax crystallization and deposition when cooled below the WAT in tubing or flowlines. Thus, in one or more embodiments, the produced and injected fluid temperature is above WAT, effectively suppressing deposition phenomena. In one or more embodiments where the outlet temperature of approximately 500° F. in the superheated region, the generated steam, although not propagating fully throughout the reservoir, ensures that the near-wellbore and tubing environment is maintained well above WAT.

Thus, in some embodiments, heating element 200 may receive the working fluid at significantly elevated pressure and maintain it at that pressure (or at a higher pressure) while it is heated. In other embodiments, heating element 200 may receive the working fluid at a relatively low pressure, but include an internal pump for pressurizing the inlet working fluid to the desired pressure prior to heating the water.

In one or more embodiments, the core components of the system may be modularized for case of transportation. For example, one or more of the following may be modularized to allow for the components to be readily connected and/or disconnected to allow the components to be transported to a site, unpacked and placed into appropriate position, and interconnected via appropriate conduits (e.g., pipes, fuel hoses, etc.): one or more heating elements, one or more control systems elements, and one or more piping and other field connections equipment.

In some embodiments, heating element 200 may be deployed in a skid-mount configuration or built into a shipping container (e.g., a 40-60 foot high-cube container or similar mobile modular construction). This may allow heating element 200 to be moved around the oilfield easily as needed. Heating element 200 is shown in this embodiment as being packed inside shipping container 210 (shown in cutaway). Heating element 200 may also include a controller 214, which may include a control system such as control system 102. Controller 214 may include local user interface elements (e.g., a monitor, keyboard, mouse, etc.) to allow for operation from within shipping container 210 manually or in connection with the control system. Additionally, or alternatively, controller 214 may include wired or wireless connectivity (e.g., Ethernet, Wi-Fi, Bluetooth, etc.) to allow for remote operation (e.g., over the Internet) and connection to the control system.

Figure 3:
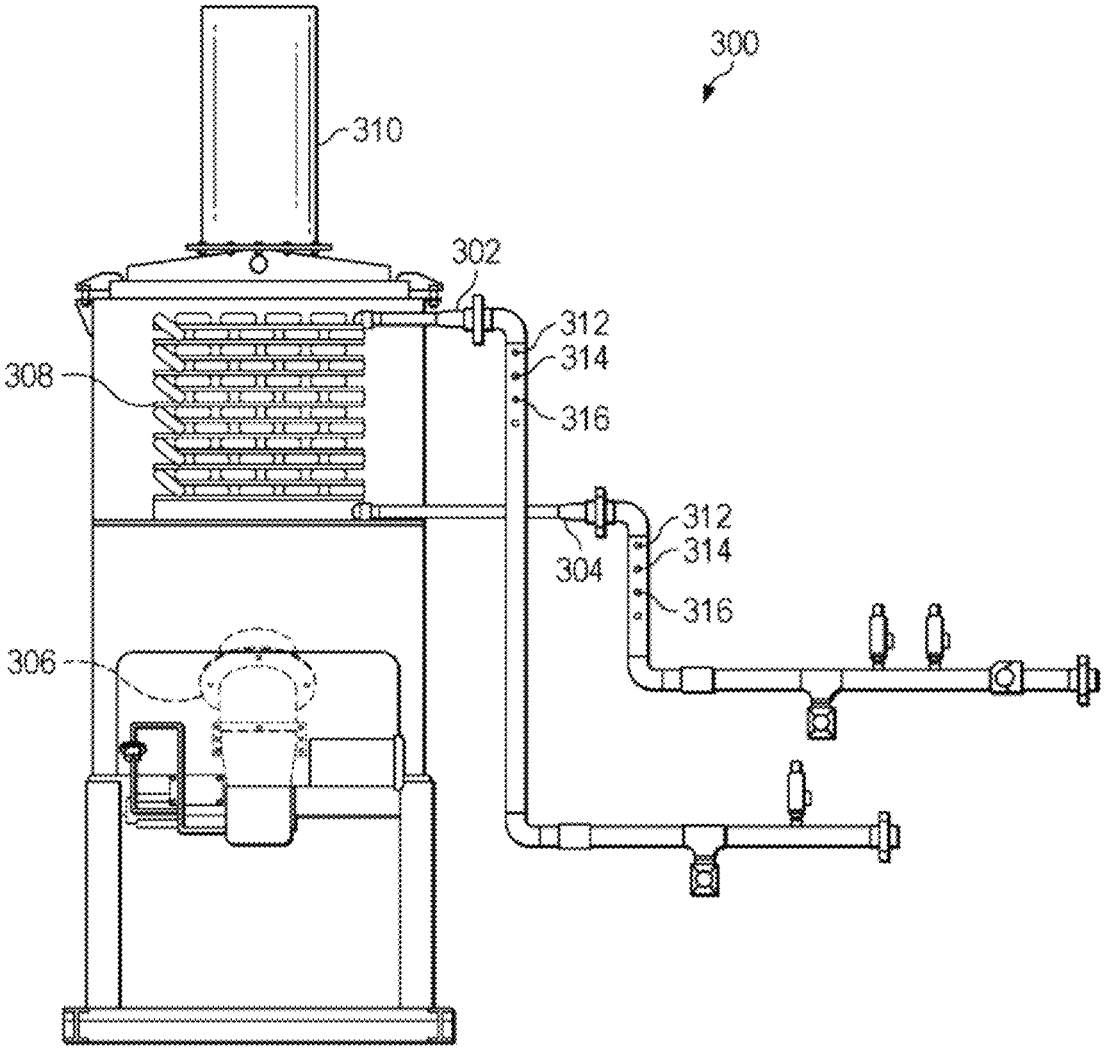
FIG. 3 illustrates a cutaway view of an example fluid heater, in accordance with embodiments of the present disclosure.
Figure 6:
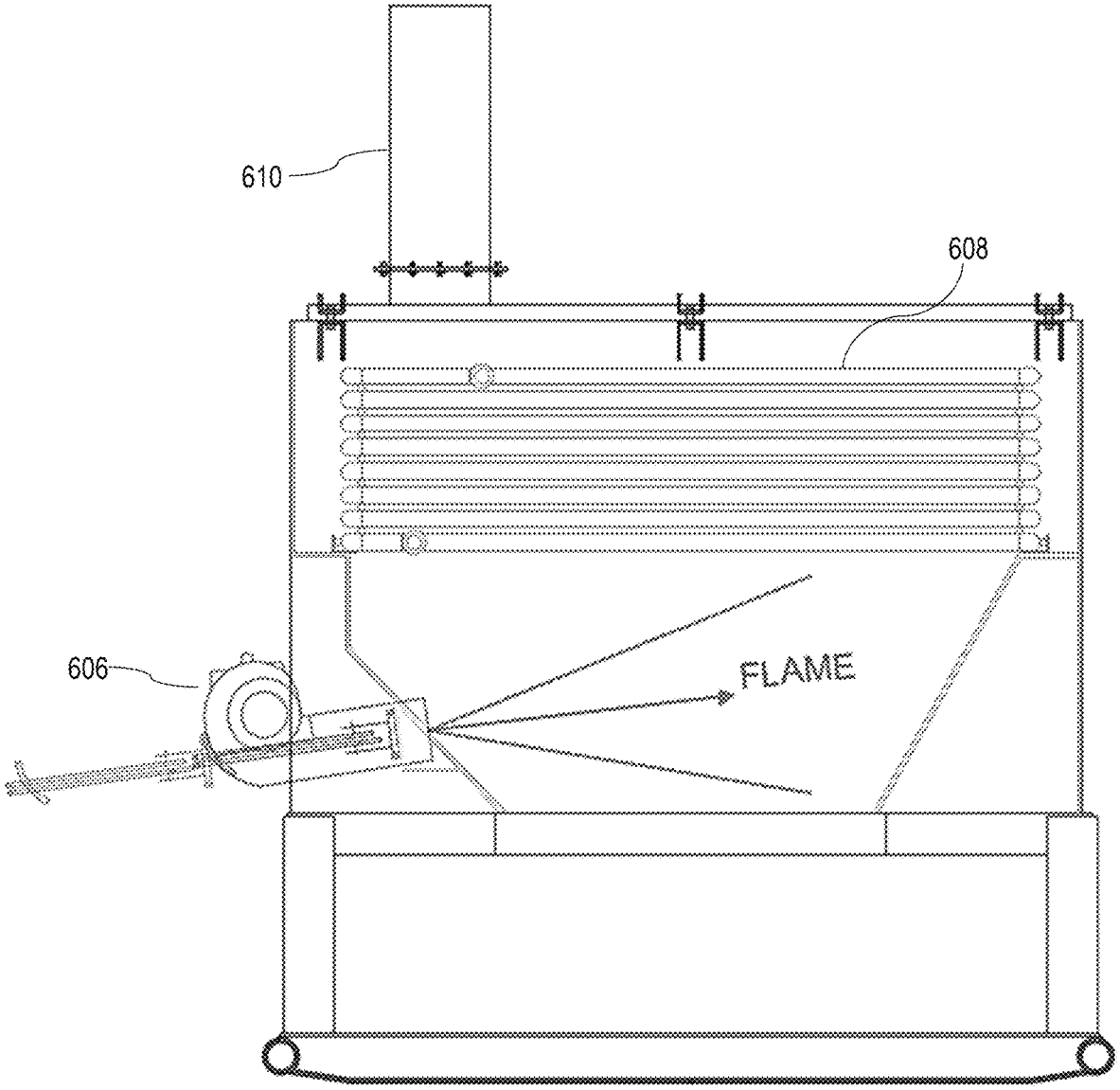
FIG. 6 illustrates a side view of an example of the heating element and pump.

Turning now to FIG. 3, a cutaway view of another example heating element 300 is shown, in accordance with some embodiments. Similar to heating element 200, heating element 300 receives a working fluid via inlet 302 and discharges the heated working fluid via outlet 304. The fluid is heated as it flows through heat exchanger coils 308, with heat being supplied by burner 306. Exhaust 310 allows the combustion gases to escape. The inlet may comprise a concentrated reducer to pressurize flow to the heat exchanger. FIG. 6 depicts a side view of one embodiment of the burner 606 in relation to the coils 608 and exhaust 610.

Figure 4A:
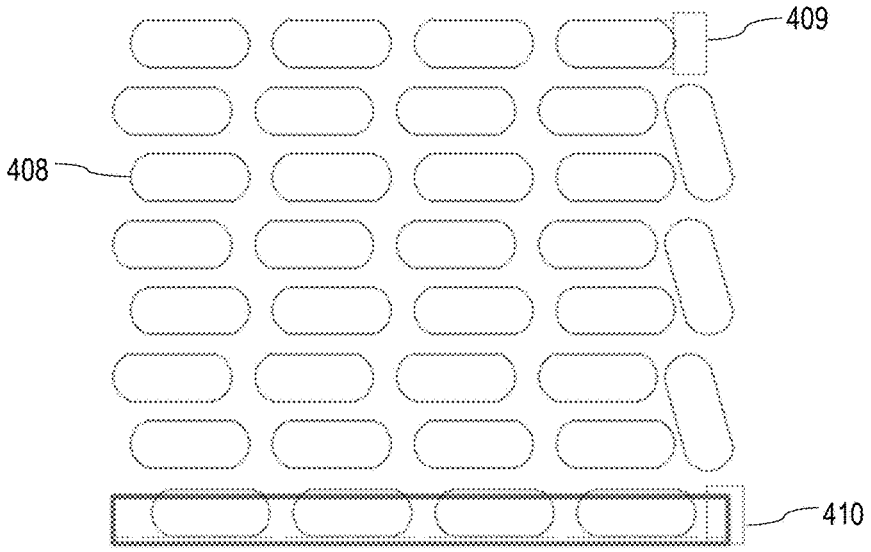
FIG. 4A illustrates a cutaway view of an example of the coils of the heat exchanger.
Figure 4B:
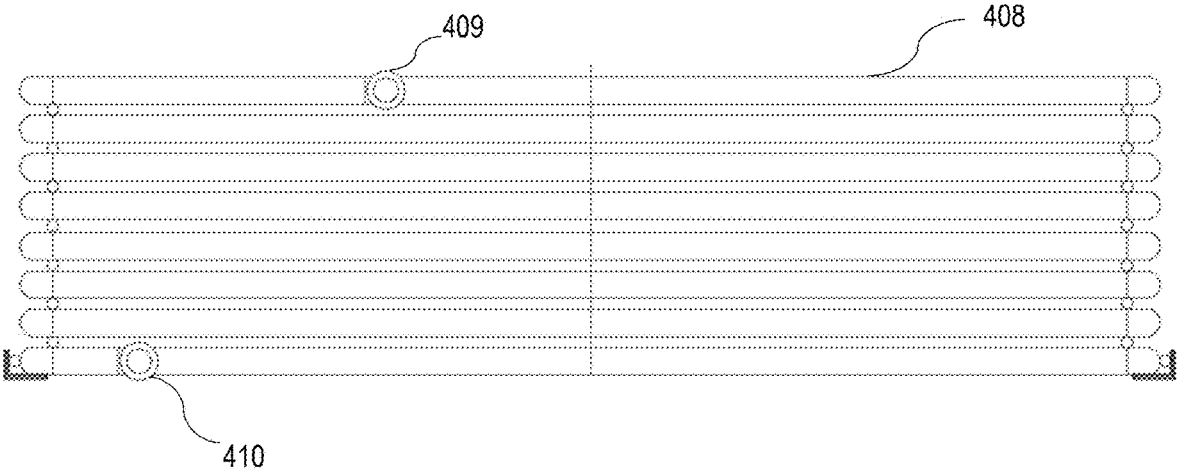
FIG. 4B illustrates a side view of an example of the heat exchanger.

In the embodiment shown in FIG. 3, heat exchanger coils 308 may be implemented as a multi-stage, multi-pass coil. As shown in FIGS. 4A and 4B, the coils comprise 1½ inch piping with half collar connectors on each end. The connector pieces may be Short Radius 90-degree elbow or any other connector piece that allows for fluid communication between the piping and the inlet and the piping and the outlet. In one embodiment, sixty-nine (69) 1½ inch piping pieces are used for the heater, each 78¾ inches long. The pipes comprise turn connector pieces as known in the art.

The pipes coupled to inlet 302 and outlet 304 may include temperature gauges 312, pressure gauges 314, flow sensors 316, and any other desired data gathering equipment in order to allow for monitoring and control of heating element 300. Other sensors may also be present elsewhere in the system, such as downhole in the wellbore.

In one embodiment, the system and method comprise a compact helical coil having a rectangular packed module of about 22.0625 in (H)×26 in (W)×86 in (L) comprises approximately thirty-five tube pairs, each tube pair including two 86 in straight legs joined by a U-bend, thereby providing an overall flow path of approximately 150-200 m from inlet to outlet. The coil is formed of ASME SA106 Grade B and/or ASTM A213 T12 Schedule 80 tubing with NPS 1.5 in and an effective internal diameter of about 38 mm, yielding an effective internal volume of about 0.128-0.227 $m^3$. The steam generator is fired at ≥5 MMBTU/hr with a tube-metal temperature limit below about 650° C., and is configured to produce an outlet stream having a steam quality of at least about 80% and a temperature of at least about 500° F. with about 36-72° F. of superheat above saturation at the selected injection pressure. When operated at about 1,000-1,500 bwpd, the coil affords a global (liquid-equivalent) residence time of about 46.5-82.2 s (at 1,500 bwpd), with corresponding average fluid velocities of about 5.3-8.0 ft/s. Such conditions are sufficient to reduce viscosity of wax-prone light-medium crude to ≤about 10 cP at or near the sandface, thereby improving hydrocarbon mobility and flow assurance while minimizing hot spots and scaling under closed-loop control.

In one or more embodiments, downhole conditions and flow-assurance processes interface with the control system. In these embodiments field devices may comprise downhole pressure and temperature gauges, fiberoptic cables (distributed temperature sensing and/or distributed acoustic sensing) for steam distribution profile information, and surface wax and/or paraffin monitors to analyze change in pressure or heat-flux proxies. In one or more embodiments, the filed devices may also comprise injection header temperature control (such as heat-traced sections), pigging port analyzers, and differential-pressure-based wax build-up sensors to alarm at pre-determined amounts.

As shown in FIG. 3 but not specifically labeled, the pipes coupled to inlet 302 and outlet 304 may also include various plumbing fittings, valves, pressure relief hardware, etc. The plumbing hardware, pipes, heat exchanger coils, and other components may be made of any suitable material (e.g., steel, stainless steel, copper, brass, bronze, aluminum, PVC, etc.) in specific implementations.

Figure 5:
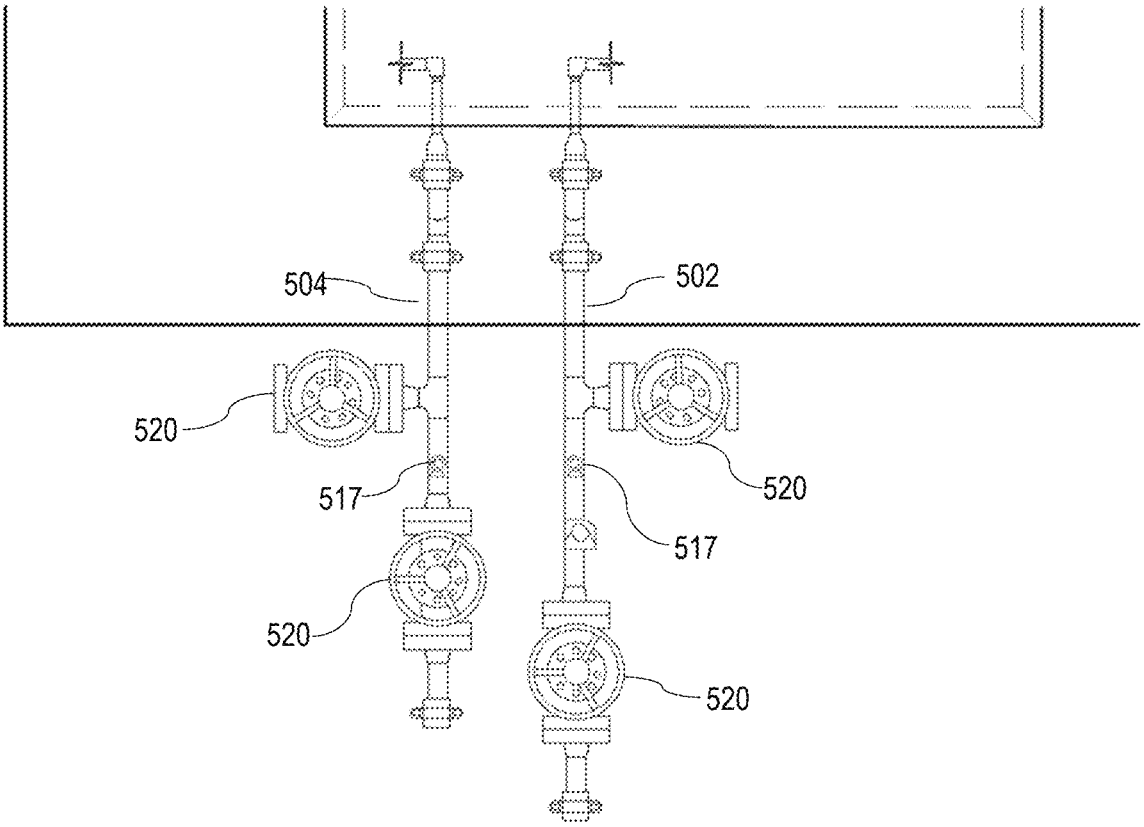
FIG. 5 illustrates a top view of an example of the piping on the inlet and outlet of the heating element.

An embodiment of relevant sections of the pipes is shown in FIG. 5. FIG. 5 shoes the outlet 504 and inlet 502 piping. On each are multiple gate valves 520 outside of the operational container wall. In one embodiment, the gate valves 520 are 2-inch gate valve that control flow and may be manually actuated or automated through the control system. Relief valves 517 are also shown. A suitable size for the relief valves may include ¾ inch, however, other sizes may be appropriate.

For the purpose of understanding the SYSTEM AND METHOD FOR SUPERHEATED WORKING SUPERHEATED WORKING FLUID INJECTION INTO A WELL, references are made in the text to exemplary embodiments of an SYSTEM AND METHOD FOR SUPERHEATED WORKING SUPERHEATED WORKING FLUID INJECTION INTO A WELL, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

What is claimed is:

1. A method for enhancing hydrocarbon recovery from a hydrocarbon reservoir, the method comprising:

a. pumping a working fluid through a once-through flow path heating element to produce superheated working fluid, wherein said working fluid is subject to both convection and radiative heating within said heating element, and wherein said heating element comprises a plurality of coils that are designed with selected alloys, internal diameter, outer diameter, wall thickness, and coil length to achieve Re=2,500-10,000; and b. injecting said superheated working fluid into a hydrocarbon-bearing formation through a wellbore as a working fluid injection flow, wherein said wellbore comprises a wellhead; and c. configuring a supervisory control and data acquisition system to cause injection within an envelope of injection pressures up to 3,000 psi and outlet steam temperatures between 260° C. and 650° C., with a steam fraction of at least 30%.

2. The method of claim 1 wherein said hydrocarbon viscosity is reduced to less than 50 cP through contact with said working fluid injection flow in said injecting step.

3. The method of claim 1 wherein said supervisory control and data acquisition system comprises:

a. one or more remote field devices configured to generate operational data associated with said pumping step and said injecting step;

b. at least one data acquisition unit comprising a programmable logic controller configured to receive and process signals from at least one of said one or more remote field devices;

c. a communication network operatively coupled to said data acquisition unit, said communication network being configured to transmit real-time operational data; and d. a centralized control interface comprising a human-machine interface configured to receive said operational data and present a visualization thereof.

4. The method of claim 1 wherein said heating element comprises a heat exchanger a fuel-fired burner that comprises a flame and exhaust, wherein said heat exchanger comprises a fluid inlet and a fluid outlet and said working fluid is pumped through said plurality of coils.

5. The method of claim 1 further comprising a treatment step before said pumping step wherein said working fluid composition is conditioned to meet the following limits to ensure ≥85% wet steam quality: Hardness ≤0.1 mg/L, Dissolved Oxygen ≤0.05 mg/L, Iron ≤0.05 mg/L, Silica ≤50 mg/L, Oil and grease ≤2 mg/L, pH at steam unit inlet between 5.0-5.5, Suspended Solids ≤2 mg/L, Total Dissolved Solids <5,000 mg/L, Total Alkalinity ≤2,000 mg/L, and flow capacity between 2,500 and 3,000 bwpd.

6. The method of claim 2 wherein said programmable logic controller consists of at least one of the following: a burner management system, one or more PID loops for flow, outlet temperature, coil pressure deferential, and fuel to air ratio, and modeling-based supervisory control for viscosity.

7. The method of claim 3 wherein said operational data consists of at least one parameter selected from the group consisting of: temperature of said working fluid, pressure of said working fluid at said fluid inlet, pressure of said working fluid at said fluid outlet, level of said working fluid, pH of said working fluid, total dissolved solids in said working fluid, temperature of said plurality of coils, pressure within said plurality of coils, said working fluid flow velocity, viscosity of said working fluid flow, fuel flow velocity of said burner, burner flame detection, oxygen concentration in said burner exhaust, carbon monoxide concentration in said burner exhaust, wellhead temperature, wellhead pressure, on working fluid injection flow.

8. The method of claim 3, wherein said supervisory control and data acquisition system monitors and processes real-time data from said plurality of remote field devices.

9. The method of claim 3 wherein said remote field devices comprise at least one of the group consisting of smart transmitters (4-20 mA/HART), thermocouples/RTDs, Coriolis or magnetic flowmeters, inline viscometer, pressure transmitters, pH/ORP, DO, turbidity/SS meters, and oil-in-water analyzer.

10. A system for enhancing hydrocarbon recovery from a hydrocarbon reservoir comprising:

a. a heating element comprising a fuel-fired burner, heat exchanger comprising a plurality of coils designed with selected alloys, internal diameter, outer diameter, wall thickness, and coil length to achieve Re=2,500-10,000, and an inlet and an outlet wherein a working fluid is directed to said heating element through said inlet, flows through said heat exchanger coils, and flows out of said heating element through said outlet;

b. a working fluid holding tank wherein said holding tank is in fluid communication with said inlet and wherein said working fluid is directed to said heat exchanger and pressured at said inlet such that said working fluid exits said outlet at 2:80% vapor fraction and superheated up to 260° C. and is injected into a hydrocarbon-bearing formation through a wellbore;

c. a plurality of analyzers and sensors on or in said heating element and said working fluid holding tank that gather operational data;

d. a data acquisition unit communicatively coupled to said plurality of analyzers and sensors and comprising a programmable logic controller to receive signals from said plurality of analyzers and sensors and to execute predetermined control logic for managing said heat exchanger and fuel-fired d. burner; and e. a centralized control interface comprising at least one human-machine interface that displays real-time operational data and a data historian.

11. The system of claim 10 wherein said holding tank further comprises staged filtration and at least one pretreatment unit.

12. The system of claim 10 wherein said working fluid is directed to said heat exchanger and said injection through insulated pipes that comprise isolation valves, wherein said isolation valves are in communication with said data acquisition unit and said programmable logic controller such that said programmable logic controller performs automated control of said isolation valves to regulate flow rate, pressure, and temperature of said working fluid.

13. The system of claim 10 wherein said plurality of coils are designed with sufficient residence time to heat said working fluid such that when it comes into contact with said hydrocarbon-formation, the viscosity of the hydrocarbon is reduced to below 50 cP.

14. The system of claim 10 wherein said fuel-fired burner is a forced-draft gas burner with an adjustable turndown ratio and a minimum heat capacity of 5 MMBTU/hr and the maximum wall temperature of said fuel-fire burner limited to 650° C.

15. The system of claim 10 wherein said fuel-fired burner is at least partially fired by natural gas produced onsite.

* * * * *